US010047999B2

(12) United States Patent
Yang et al.

(10) Patent No.: US 10,047,999 B2
(45) Date of Patent: Aug. 14, 2018

(54) REFRIGERATOR

(71) Applicant: LG ELECTRONICS INC., Seoul (KR)

(72) Inventors: Changwoan Yang, Seoul (KR); Hyeongil Kim, Seoul (KR); Heonjae Jang, Seoul (KR); Booyoun Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/424,114

(22) Filed: Feb. 3, 2017

(65) Prior Publication Data

US 2017/0227281 A1 Aug. 10, 2017

(30) Foreign Application Priority Data

Feb. 5, 2016 (KR) ..... 10-2016-0015206

(51) Int. Cl.

| | |
|---|---|
| ***A47B 96/04*** | (2006.01) |
| ***F25D 25/02*** | (2006.01) |
| ***F25D 23/06*** | (2006.01) |
| ***F25D 11/00*** | (2006.01) |
| ***F25D 23/02*** | (2006.01) |

(52) U.S. Cl.

CPC ..... *F25D 25/025* (2013.01); *F25D 11/00* (2013.01); *F25D 23/028* (2013.01); *F25D 23/067* (2013.01)

(58) Field of Classification Search

CPC ..... A47B 88/467

USPC ... 312/334.7–334.9, 334.12, 334.15, 334.18, 312/334.37, 334.43, 334.45, 405.1

See application file for complete search history.

(56) References Cited

U.S. PATENT DOCUMENTS

| | | | | |
|---|---|---|---|---|
| 4,098,094 | A * | 7/1978 | Linstromberg | F25C 5/005 312/311 |
| 5,209,555 | A * | 5/1993 | Camilleri | A47B 88/402 312/311 |
| 5,490,724 | A * | 2/1996 | Domenig | A47B 88/467 312/333 |
| 5,785,400 | A * | 7/1998 | Grieser | A47B 88/487 312/330.1 |
| 6,378,969 | B1 * | 4/2002 | Ferrari | A47L 388/467 312/334.12 |
| 6,481,812 | B1 * | 11/2002 | Domenig | A47B 88/40 312/334.27 |
| 2003/0107308 | A1 * | 6/2003 | Kueng | A47B 88/402 312/334.1 |
| 2005/0127803 | A1 * | 6/2005 | Chen | A47B 88/956 312/334.12 |
| 2011/0018414 | A1 * | 1/2011 | Kim | F25D 25/025 312/402 |

* cited by examiner

*Primary Examiner* — Matthew W Ing
(74) *Attorney, Agent, or Firm* — Fish & Richardson P.C.

(57) ABSTRACT

A refrigerator includes a cabinet defining a storage compartment, a door, a drawer, a roller at a side of the drawer, a support rail at a side of the storage compartment for guiding movement of the roller in a forward-rearward direction, and a support surface in the support rail for supporting the roller, the support surface including a downhill guide section that slopes downward from a rear of the refrigerator to a front of the refrigerator and a slide guide section that extends from the downhill guide section.

15 Claims, 8 Drawing Sheets

REFRIGERATOR

CROSS-REFERENCE TO RELATED APPLICATION

The application claims priority under 35 U.S.C. § 119 and 35 U.S.C. § 365 to Korean Patent Application No. 10-2016-0015206, filed Feb. 5, 2016, whose entire disclosure is hereby incorporated by reference.

FIELD

This document relates to a refrigerator.

BACKGROUND

A refrigerator is an electric home appliance that is used to store food in a refrigerated state or in a frozen state.

In recent years, the capacity of refrigerators has increased, and a home bar, an ice maker, a shelf, or a door box has been mounted on the rear of a door of the refrigerator.

SUMMARY

It is a first object of the present disclosure to provide a refrigerator configured such that a drawer automatically glides down or slides along a support rail when a door is opened, whereby the withdrawal of the drawer is automatically achieved.

It is a second object of the present disclosure to provide a refrigerator configured such that a drawer is not interlocked with a door but is accelerated while being guided along a support rail, whereby the drawer is automatically withdrawn.

It is a third object of the present disclosure to provide a refrigerator configured such that a drawer can be automatically withdrawn using only a support rail.

It is a fourth object of the present disclosure to provide a refrigerator configured such that the automatic withdrawal distance of a drawer is limited by a support rail but such that the drawer can be manually further withdrawn along the support rail.

According to an innovative aspect of the subject matter described in this application, a refrigerator includes a cabinet that defines a storage compartment with an opening; a door rotatably coupled to the cabinet and configured to open and close the opening; a drawer located in the storage compartment and configured to store food; a roller located at a side of the drawer; a support rail that is located at a side of the storage compartment and that is configured to guide movement of the roller in a forward-rearward direction; and a support surface that is located in the support rail, that is configured to support the roller, and that includes (i) a downhill guide section that slopes downward from a rear of the refrigerator to a front of the refrigerator and (ii) a slide guide section that extends from the downhill guide section.

The refrigerator may include one or more of the following optional features. The downhill guide section defines a downhill guide section angle between 30 degrees and 90 degrees with respect to a bottom of the refrigerator. The slide guide section includes a recessed section that defines a recess. The recessed section includes a first inclined section that slopes downward from a front end of a horizontal section of the slide guide section to a lowest point of the recess, the front end of the horizontal section being nearer to the front of the refrigerator than to the rear of the refrigerator; and a second inclined section that slopes upward from the lowest point of the recess to the front of the refrigerator.

The slide guide section further includes a first horizontal section that extends horizontally towards a front of the refrigerator from a front end of the downhill guide section, and the recessed section that is located at a front end of the first horizontal section. A lowest point of the recessed section is lower than the first horizontal section. A height of a front end of the recessed section with respect to a bottom of the support rail is less than or equal to a height of the first horizontal section with respect to the bottom of the support rail. The slide guide section further includes a second horizontal section that extends horizontally from a front end of the recessed section towards a front of the refrigerator and an inclined slide section that slopes downward from a front end of the second horizontal section towards the bottom of the refrigerator.

The inclined slide section defines an inclined slide section angle with respect to the bottom of the refrigerator, the inclined slide section angle being less than the downhill guide section angle. The slide guide section further includes a slide limit section that extends upward from a front end of the inclined slide section and that is configured to stop the roller. The slide limit section may be concave. The support surface further includes a manual withdrawal guide section that extends forward from a front end of the slide limit section to the front of the refrigerator.

The door includes a door storage unit that is configured to store food, that protrudes rearward from a rear part of the door, that faces the storage compartment, and that contacts the drawer based on the door being closed while the roller is located on the downhill guide section. The door may include a pad that is located on a surface of the door storage unit, that faces the storage compartment, and that is configured to contact the drawer based on the door being closed while the roller is located on the downhill guide section. The refrigerator may include additional drawers that are located above or below the drawer; additional rollers that are located at the drawers; and additional support rails that are located above or below the support rail.

DETAILED DESCRIPTION

Figure 1:
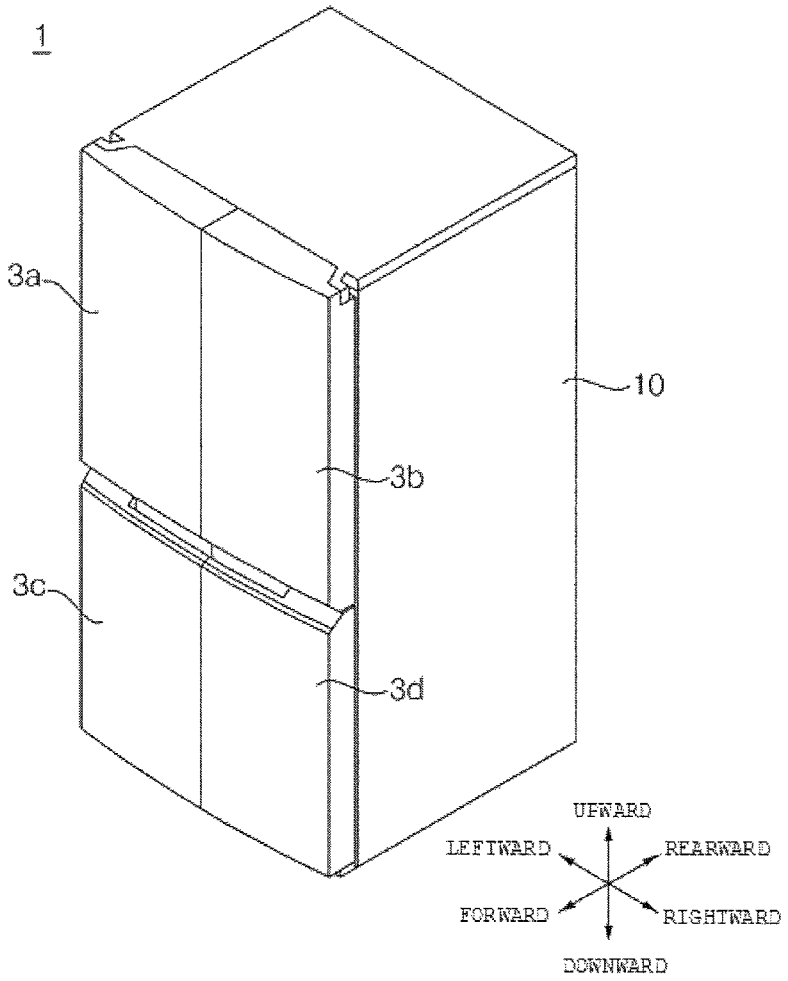
FIG. 1 is a perspective view of an example refrigerator.
Figure 2:
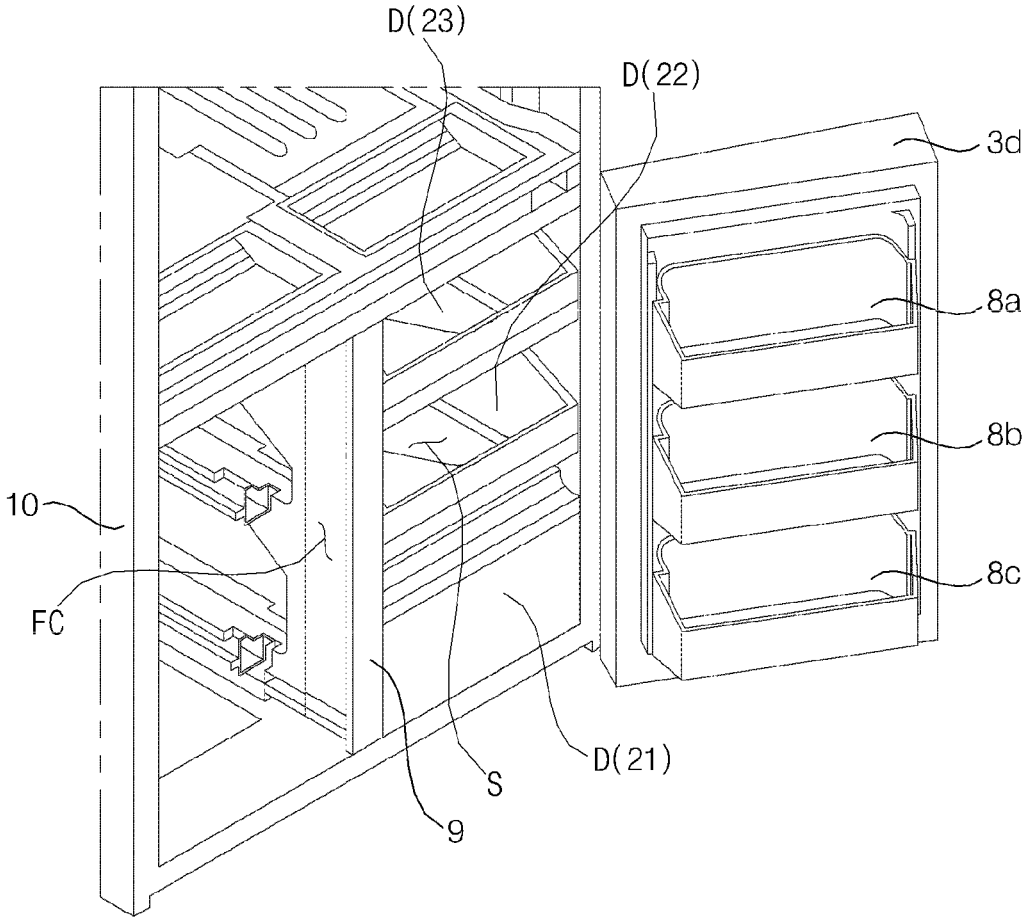
FIG. 2 is a partial view of an example refrigerator and an example door being open.
Figure 3:
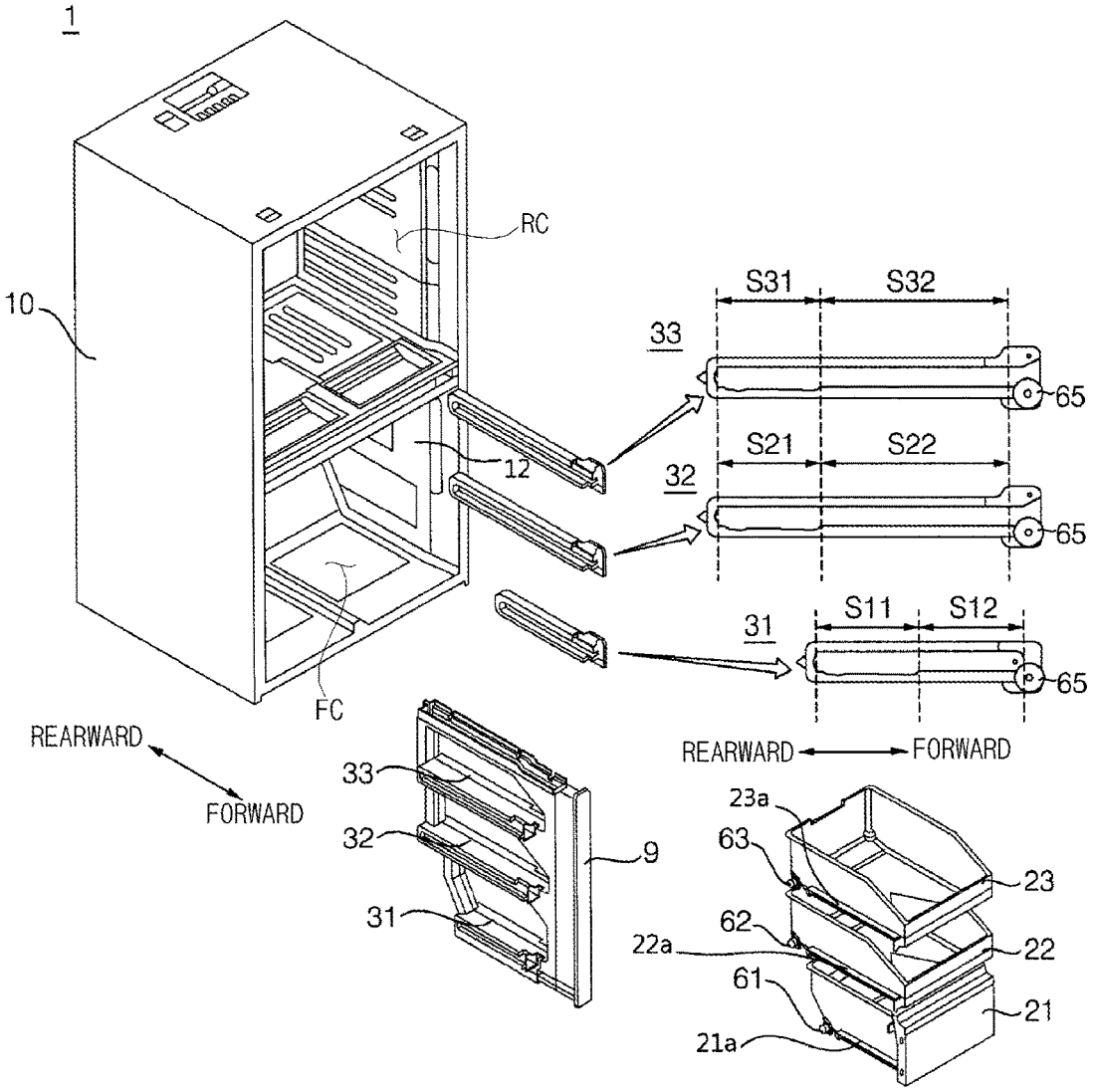
FIG. 3 is an exploded perspective view of example major parts of an example refrigerator.

FIG. 1 illustrates an example refrigerator 1. FIG. 2 illustrates an example door being open. FIG. 3 illustrates example major parts of a refrigerator 1. FIG. 1 also illustrates a definition of "forward," "rearward," "leftward,"

"rightward," "upward," and "downward" directions set forth herein. However, these directions are used merely to clearly describe the present disclosure. Consequently, the above directions may be differently defined in some implementations.

Referring to FIGS. 1 to 3, a refrigerator 1 may include a cabinet 10 having compartments RC and FC defined therein and doors 3*a*, 3*b*, 3*c*, and 3*d* for opening and closing the compartments RC and FC. The doors 3*a*, 3*b*, 3*c*, and 3*d* may be hinged to the cabinet 10.

The front surfaces of the compartments RC and FC are open such that food is introduced and removed through the front surfaces of the compartments RC and FC. The open front surfaces of the compartments RC and FC may be opened and closed by the doors 3*a*, 3*b*, 3*c*, and 3*d*. Cool air is supplied into the compartments RC and FC. The compartments RC and FC may be sealed by the doors 3*a*, 3*b*, 3*c*, and 3*d* such that cool air does not leak from the compartments RC and FC.

Two or more compartments RC and FC may be provided. For a bottom freezer type refrigerator, the cabinet 10 is partitioned into the upper part and the lower part, and the compartments RC and FC are respectively provided in the upper part and the lower part of the cabinet 10. In this case, the lower compartment FC is a freezing compartment, the interior temperature of which is maintained below 0° C., and the upper compartment RC is a refrigerating compartment, the interior temperature of which is maintained above 0° C. In the following description, a "compartment" may be a refrigerating compartment or a freezing compartment, unless mentioned otherwise.

Each of the compartments RC and FC may be opened and closed by a pair of doors. For example, the refrigerating compartment RC may be opened and closed by a pair of refrigerating compartment doors 3*a* and 3*b*, and the freezing compartment FC may be opened and closed by a pair of freezing compartment doors 3*c* and 3*d*.

A storage compartment S constitutes all or portions of the compartments RC and FC. The storage compartment S may be defined as a region that is opened and closed by the doors 3*a*, 3*b*, 3*c*, and 3*d*. One compartment may constitute one storage compartment. In some implementations, one compartment (e.g., the freezing compartment FC) may be partitioned into left and right storage compartments by the vertical partition 9. The flow of cool air between the storage compartments may not be completely blocked by the vertical partition 9. In some implementations, the vertical partition 9 may be provided with through holes, through which the storage compartments communicate with each other.

Hereinafter, the storage compartment S will be referred to as a right storage compartment of the freezing compartment FC, a description of which will follow. However, the following description may be applied to other storage compartments.

Door storage units 8*a*, 8*b*, and 8*c* for storing food may be formed in the rear part of the door 3*d*, e.g., the part of the door 3*d* that faces the open front surface of the storage compartment S. The door storage units 8*a*, 8*b*, and 8*c* protrude rearward from the rear part of the door 3*d* for providing spaces for storing food that is frequently taken out of the refrigerator, such as dairy products, beverages, vegetables, etc. In the state in which the door 3*d* is closed, at least portions of the door storage units 8*a*, 8*b*, and 8*c* are located in the storage compartment S.

At least one drawer D may be disposed in the storage compartment S. The drawer D is provided to store or hold food. A plurality of drawers D may be arranged in the upward-downward direction. Each of the drawers D is formed in the shape of a box that provides a predetermined sized food storage space. Each of the drawers is also referred to as a container or a bin.

At least one drawer D may be provided in the storage compartment S. Hereinafter, three drawers 21, 22, and 23 will be described as being disposed in the storage compartment S, which is located at the right side of the vertical partition 9, so as to be arranged at different heights in the upward-downward direction. Hereinafter, the drawers D will be referred to as a first drawer 21, a second drawer 22, and a third drawer 23.

Rollers 61, 62, and 63 are provided at opposite sides of the drawers 21, 22, and 23.

The rollers 61, 62 and 63 are rotated about rotary shafts (not shown) protruding from the drawers 21, 22, and 23 in the lateral direction. In addition, the rollers 61, 62 and 63 are supported and guided such that the rollers 61, 62 and 63 are movable along support rails 31, 32, and 33, a description of which will follow, in the forward-rearward direction. The rollers 61, 62 and 63 are shown as being provided at one side of the drawers 21, 22, and 23 in FIG. 3. However, the rollers 61, 62 and 63 are also provided at the other side of the drawers 21, 22, and 23.

In the storage compartment S, pairs of support rails 31, 32, and 33 may be provided so as to respectively correspond to the drawers 21, 22, and 23. The support rails 31, 32, and 33 may include a pair of first support rails 31 for supporting opposite sides of the first drawer 21, a pair of second support rails 32 for supporting opposite sides of the second drawer 22, and a pair of third support rails 33 for supporting opposite sides of the third drawer 23.

The drawers 21, 22, and 23 are respectively supported by the support rails 31, 32, and 33, which are fixed in the storage compartment S. In some implementations, rollers 61, 62, and 63, provided at the opposite sides of the drawers 21, 22, and 23, are respectively supported by the support rails 31, 32, and 33 provided at the opposite sides of the drawers 21, 22, and 23.

The support rails 31, 32, and 33 may also be respectively provided with rollers 65. The drawers 21, 22, and 23 may be respectively provided at the opposite sides thereof with guide ribs 21*a*, 22*a*, and 23*a*, which extend in the forward-rearward direction. The guide ribs 21*a*, 22*a*, and 23*a* may be supported by the rollers 65. The rollers 65 are respectively provided to balance the drawers 21, 22, and 23. The rollers 65 may be disposed before the rollers 61, 62, and 63 so as to respectively support the guide ribs 21*a*, 22*a*, and 23*a*. The rollers 61, 62, and 63, provided at the drawers 21, 22, and 23, are respectively supported by the support rails 31, 32, and 33, and the guide ribs 21*a*, 22*a*, and 23*a*, provided at the drawers 21, 22, and 23, are respectively supported by the rollers 65, provided at the support rails 31, 32, and 33, whereby the drawers 21, 22, and 23 are balanced.

The guide ribs 21*a*, 22*a*, and 23*a* may be horizontally formed. In some implementations, the guide ribs 21*a*, 22*a*, and 23*a* may be inclined from the rear to the front.

In some implementations, one of each pair of the support rails 31, 32, and 33, which respectively correspond to the drawers 21, 22, and 23, is fixed to the inner surface 12 of the cabinet 10, and the other is fixed to the vertical partition 9, which faces the inner surface 12 of the cabinet 10. For a refrigerator configured such that a single compartment is opened and closed by a single door, the support rails may be fixed to opposite inner surfaces of the cabinet.

The support rails 31, 32, and 33 may have different lengths depending on the size of the drawers 21, 22, and 23, but may have substantially the same structure. The support rails 31, 32, and 33 may include automatic withdrawal guide sections S11, S21, and S31 and manual withdrawal guide sections S12, S22, and S32 formed on lower support surfaces thereof that contact the rollers 61, 62, and 63 so as to be sequentially arranged from the rear to the front.

The first support rail 31 and the third support rail 33 may have substantially the same structure as the second support rail 32. Hereinafter, the second support rail 32 will be described by way of example.

Figure 4:
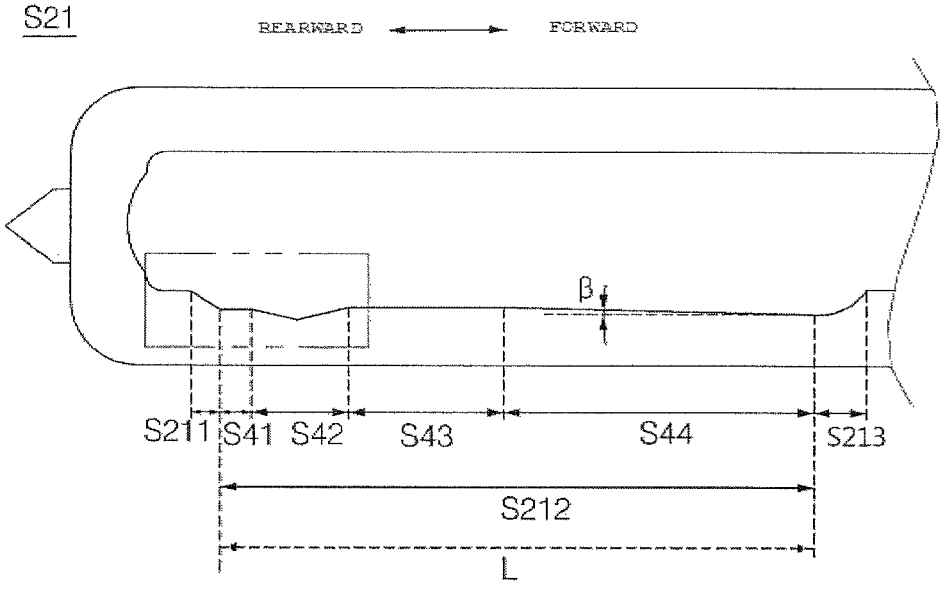
FIG. 4 is a partial side view of an example second support rail.
Figure 5:
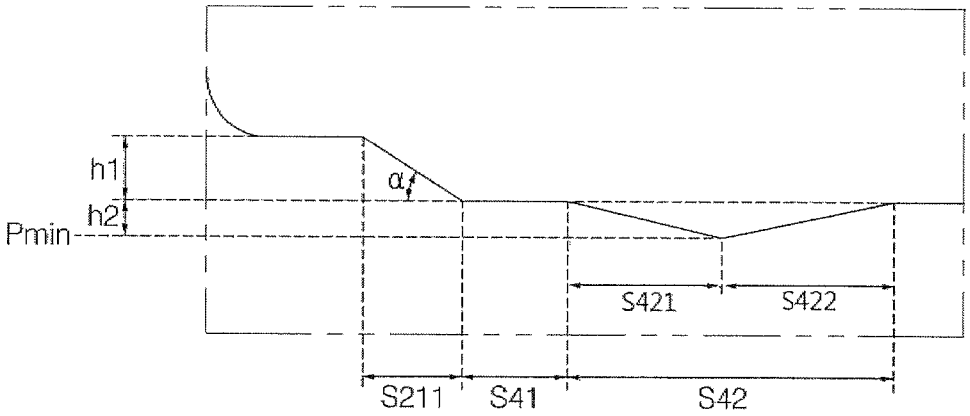
FIG. 5 is an enlarged view of the dashed part in FIG. 4.
Figure 6:
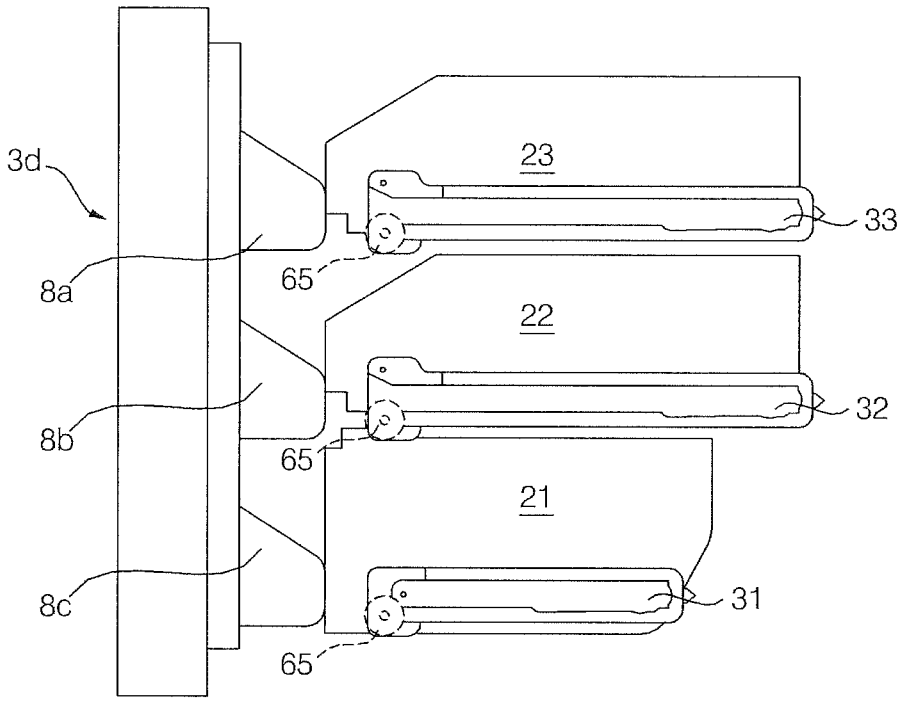
FIG. 6 is a right side view of an example storage compartment when a door is closed.
Figure 7:
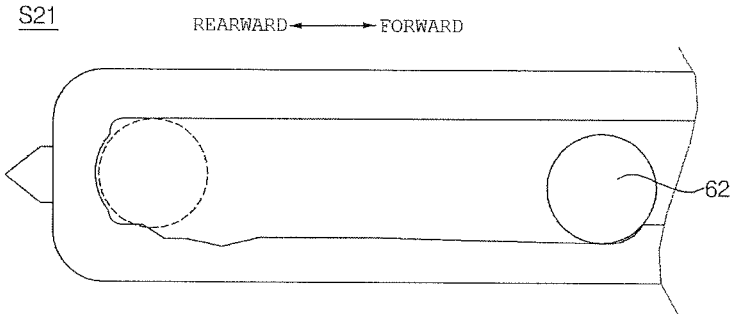
FIG. 7 is a side view of an example roller on a support surface of an example second support rail when a door is completely open.

FIG. 4 illustrates an example second support rail 32. FIG. 5 illustrates the part in the dashed line of FIG. 4. FIG. 6 illustrates an interior of an example storage compartment S when a door 3*d* is closed. FIG. 7 illustrates an example position of an example roller on a support surface of an example second support rail 32 when a door 3*d* is completely open. Hereinafter, a description will be made with reference to FIGS. 4 to 6.

The automatic withdrawal guide section S21 may include a downhill guide section S211, a slide guide section S212, and a slide limit section S213, which are sequentially arranged from the rear to the front.

The downhill guide section S211 may be inclined downward from the rear to the front. The downhill guide section S211 may have an inclination angle α of 30 to less than 90 degrees, e.g., 35 to 40 degrees.

The slide guide section S212 may extend forward from the front end of the downhill guide section S211 for guiding the roller 62 such that the roller 62 rolls down along the downhill guide section S211 and may naturally slide a predetermined distance L further forward while the roller 62 moves forward.

The roller 62 glides down along the downhill guide section S211. After entering the slide guide section S212, the roller 62 continuously rolls along the slide guide section S212 even when no external force is applied to the drawer 22, e.g., naturally slides, due to the increased kinetic energy during downhill movement and acceleration caused by the height difference between the rear end and the front end of the slide guide section S212. That is, the roller 62 naturally rolls along the slide guide section S212 even when no external force for pulling the drawer 22 forward is applied to the drawer 22 in the state in which the roller 62 is located within the slide guide section S212. The drawer 22 may naturally move forward along the automatic withdrawal guide section S21 (e.g., may be automatically withdrawn) in response to the motion of the roller 62 along the downhill guide section S211 and the slide guide section S212.

The slide guide section S212 may include a first horizontal section S41, a recessed section S42, a second horizontal section S43, and/or an inclined slide section S44, which are sequentially arranged from the rear to the front.

The first horizontal section S41 may horizontally extend forward from the front end of the downhill guide section S211. Since the roller 62 does not directly descend from the downhill guide section S211 to the recessed section S42 but descends from the downhill guide section S211 to the recessed section S42 through the first horizontal section S41, it is possible to reduce impact and noise generated when the roller 62 enters the recessed section S42.

In the recessed section S42, the support surface for supporting the roller 62 is recessed. The recessed section S42 may be formed at the front end of the first horizontal section S41. The lowest point Pmin of the recessed section S42 may be located lower than the first horizontal section S41. In the case in which a user directly pushes the drawer 22 inward in the state in which the door 3*d* is open, the roller 62 may move rearward along the support rail 32, and may stop upon reaching the recessed section S42.

The recessed section S42 may include a first inclined section S421, which is inclined downward from the front end of the first horizontal section S41 to the lowest point Pmin, and a second inclined section S422, which is inclined upward from the lowest point Pmin to the front. The depth h2 of the recessed section S42 may be equal to or less than the height h1 that the roller 62 descends along the downhill guide section S211.

In some implementations, the first horizontal section S41 and the second horizontal section S43 may have substantially the same height. In some implementations, the front end of the second inclined section S422 may be located lower than the height of the first horizontal section S41 (e.g., the second horizontal section S43 may be lower than the first horizontal section S41). In this case, the roller may overcome the inclination of the second inclined section S422 after gliding down along the first inclined section S421 due to the height difference between the first horizontal section S41 and the front end of the second inclined section S422.

The second horizontal section S43 may be formed at the front end of the recessed section S42. The second horizontal section S43 may horizontally extend forward from the front end of the second inclined section S422. Consequently, the lowest point Pmin of the recessed section S42 is located lower than the second horizontal section S43.

When the user directly pushes the drawer 22 inward in the state in which the door 3*d* is open, the roller 62 ascends along the inclined slide section S44, a description of which will follow, and then reaches the second horizontal section S43. From this time, the roller may not return in the opposite direction (e.g., forward) but may remain within the second horizontal section S43 even in the case in which the roller 62 does not reach the recessed section S42.

The inclined slide section S44 may be downwardly inclined forward from the front end of the second horizontal section S43. After gliding down along the downhill guide section S211 and passing through the second inclined section S422, the roller 62 naturally slides along the inclined slide section S44, whereby automatic withdrawal of the drawer 22 is completed.

The inclined slide section S44 may be downwardly inclined forward. The inclined slide section S44 may have an inclination angle β less than the inclination angle α of the downhill guide section S211. In some implementations, the inclination angle β is less than 10 degrees. In some implementations, the inclination angle β may be about 2 degrees, at which the natural sliding of the roller 62 is sufficiently achieved.

The slide limit section S213 is provided to stop the roller 62 that has slid along the inclined slide section S44. The slide limit section S213 may upwardly extend forward from the front end of the inclined slide section S44. The slide limit section S213 may be concavely formed in the support surface of the support rail 32.

The manual withdrawal guide section S22 may extend forward from the front end of the slide limit section S213. In the case in which the user directly pulls the drawer 22 forward in the state in which the roller 62 is located within the slide limit section S213, the roller 62 may escape from the slide limit section S213, and may be further withdrawn forward along the manual withdrawal guide section S22.

Referring to FIG. 6, the door storage units 8*a*, 8*b*, and 8*c* for storing food may protrude rearward from the rear part of the door 3*d* that faces the storage compartment S. In the state in which the door 3*d* is closed, the door storage units 8*a*, 8*b*, and 8*c* contact the drawers 21, 22, and 23, respectively, whereby the roller 62 may remain within the downhill guide section S211 (a position indicated by a dotted line in FIG. 7). When the door 3*d* is opened, the state in which the drawers 21, 22, and 23 are supported by the door storage units 8*a*, 8*b*, and 8*c* is released, with the result that the rollers 61, 62, and 63 descend along the downhill guide section S211, whereby automatic withdrawal of the drawers 21, 22, and 23 is achieved as described above.

Figures 8A, 8B:
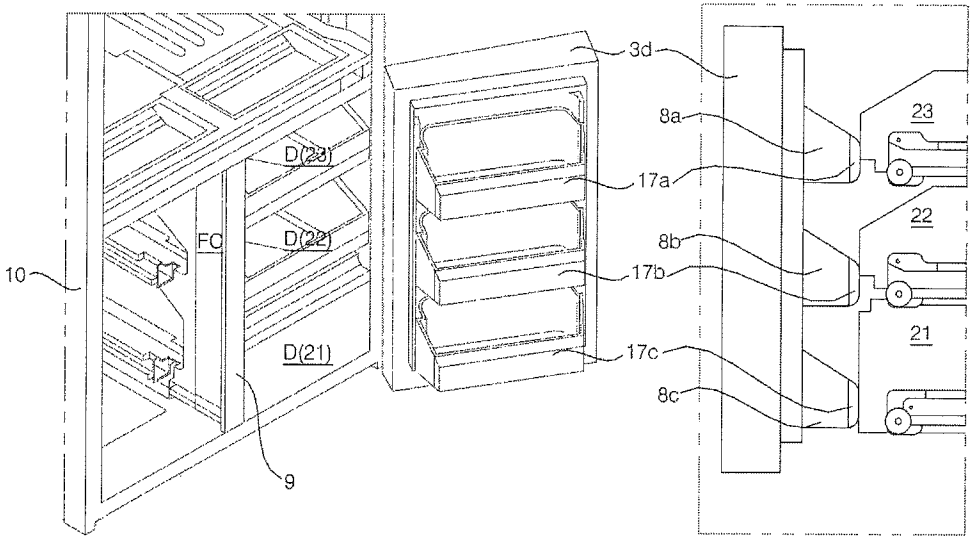
FIGS. 8(*a*) and 8(*b*) are partial views of an example refrigerator when a door is open and a right side view of an example storage compartment when the door is closed, respectively.

FIG. 8(*a*) illustrates a front of the refrigerator when a door 32 is open. FIG. 8(*b*) illustrates an interior of an example storage compartment when a door 32 is closed. Referring to FIG. 8, the door storage units 8*a*, 8*b*, and 8*c* may be provided with pads 17*a*, 17*b*, and 17*c*, respectively. The pads 17*a*, 17*b*, and 17*c* are disposed on the surfaces of the door storage units 8*a*, 8*b*, and 8*c* that face the storage compartment S so as to protrude rearward in the state in which the door 3*c* is closed.

In the case in which the door storage units 8*a*, 8*b*, and 8*c* do not contact the drawers 21, 22, and 23 due to factors, such as the depth of the storage compartment S or the lengths that the door storage units 8*a*, 8*b*, and 8*c* protrude rearward in the state in which the door 3*d* is closed, the pads 17*a*, 17*b*, and 17*c* respectively attached to the door storage units 8*a*, 8*b*, and 8*c* may contact the front ends of the drawers 21, 22, and 23 in the state in which the roller 62 is located within the downhill guide section S211.

As a result, the roller 62 may remain within the downhill guide section S211.

As is apparent from the above description, the refrigerator according to the present disclosure has the following effects.

First, the drawer automatically glides down or slides along the support rail when the door is opened, whereby the withdrawal of the drawer is automatically achieved.

Second, it is not necessary to interlock the drawer with the door in order to realize an automatic drawer withdrawal function. Consequently, an interlocking means, such as a link or a motor, is not needed.

Third, it is possible to automatically withdraw the drawer using the structure that uses a support rail.

Fourth, the automatic withdrawal distance of the drawer is limited by the support rail, but the drawer may be manually further withdrawn along the support rail, thereby improving convenience in use.

What is claimed is:

1. A refrigerator comprising:

a cabinet that defines a storage compartment with an opening;

a door rotatably coupled to the cabinet and configured to open and close the opening;

a drawer located in the storage compartment and configured to store food;

a roller located at a side of the drawer;

a support rail that is located at a side of the storage compartment and that is configured to guide movement of the roller in a forward-rearward direction; and a support surface that is located in the support rail, that is configured to support the roller, and that includes (i) a downhill guide section that slopes downward from a rear of the refrigerator to a front of the refrigerator and (ii) a slide guide section that extends from the downhill guide section, wherein the door comprises a door storage unit that defines a space configured to store food, that protrudes rearward from a rear part of the door, that faces the storage compartment, and that contacts the drawer based on the door being closed while the roller is located on the downhill guide section, and wherein the slide guide section is configured to guide the roller to the front of the refrigerator based on the door being opened and at least a part of the drawer being withdrawn through the opening.

2. The refrigerator according to claim 1, wherein the downhill guide section defines a downhill guide section angle between 30 degrees and 90 degrees with respect to a bottom of the refrigerator.

3. The refrigerator according to claim 1, wherein the slide guide section comprises a recessed section that defines a recess.

4. The refrigerator according to claim 3, wherein the recessed section comprises:

a first inclined section that slopes downward from a front end of a horizontal section of the slide guide section to a lowest point of the recess, the front end of the horizontal section being nearer to the front of the refrigerator than to the rear of the refrigerator; and a second inclined section that slopes upward from the lowest point of the recess to the front of the refrigerator.

5. The refrigerator according to claim 3, wherein:

the slide guide section further comprises a first horizontal section that extends horizontally towards a front of the refrigerator from a front end of the downhill guide section, and the recessed section that is located at a front end of the first horizontal section.

6. The refrigerator according to claim 5, wherein a lowest point of the recessed section is lower than the first horizontal section.

7. The refrigerator according to claim 6, wherein a height of a front end of the recessed section with respect to a bottom of the support rail is less than or equal to a height of the first horizontal section with respect to the bottom of the support rail.

8. The refrigerator according to claim 3, wherein the slide guide section comprises a second horizontal section that extends horizontally from a front end of the recessed section towards a front of the refrigerator.

9. The refrigerator according to claim 8, wherein the slide guide section comprises an inclined slide section that slopes downward from a front end of the second horizontal section towards the bottom of the refrigerator.

10. The refrigerator according to claim 9, wherein the inclined slide section defines an inclined slide section angle with respect to the bottom of the refrigerator, the inclined slide section angle being less than the downhill guide section angle.

11. The refrigerator according to claim 9, wherein the slide guide section further comprises a slide limit section that extends upward from a front end of the inclined slide section and that is configured to stop the roller.

12. The refrigerator according to claim 11, wherein the slide limit section is concave.

13. The refrigerator according to claim 10, wherein the support surface further comprises a manual withdrawal guide section that extends forward from a front end of the slide limit section to the front of the refrigerator.

14. A refrigerator comprising:

a cabinet that defines a storage compartment with an opening;

a door rotatably coupled to the cabinet and configured to open and close the opening;

a drawer located in the storage compartment and configured to store food;

a roller located at a side of the drawer;

a support rail that is located at a side of the storage compartment and that is configured to guide movement of the roller in a forward-rearward direction;

a support surface that is located in the support rail, that is configured to support the roller, and that includes (i) a downhill guide section that slopes downward from a rear of the refrigerator to a front of the refrigerator and (ii) a slide guide section that extends from the downhill guide section;

a door storage unit that defines a space configured to store food, that protrudes rearward from a rear part of the door, and that faces the storage compartment; and a pad that is located on a surface of the door storage unit, that faces the storage compartment, and that is configured to contact the drawer based on the door being closed while the roller is located on the downhill guide section, wherein the slide guide section is configured to guide the roller to the front of the refrigerator based on the door being opened and at least a part of the drawer being withdrawn through the opening.

15. The refrigerator according to claim 1, further comprising:

additional drawers that are located above or below the drawer;

additional rollers that are located at the drawers; and additional support rails that are located above or below the support rail.

* * * * *